US005598679A

United States Patent [19]

Orton et al.

[11] Patent Number: 5,598,679

[45] Date of Patent: Feb. 4, 1997

[54] CAST CONCRETE BLOCK AND METHOD OF MAKING SAME

[76] Inventors: Michael V. Orton, 302 W. 100 South, Manti, Utah 84642; David S. Orton, 301 S. 6th Ave., Princeton, Minn. 55371

[21] Appl. No.: 359,915

[22] Filed: Dec. 20, 1994

[51] Int. Cl.[6] ..... E04C 2/04

[52] U.S. Cl. ..... 52/609; 52/603; 52/604; 52/608; 52/596; 405/284; 405/286

[58] Field of Search ..... 52/98, 100, 596, 52/608, 603, 604, 609; 404/34, 39, 42; 405/284, 285, 286

[56] References Cited

U.S. PATENT DOCUMENTS

| | | | |
|---|---|---|---|
| 1,503,931 | 8/1924 | Wightman | 52/603 |
| 1,855,987 | 4/1932 | Rommer | 52/608 |
| 1,872,522 | 8/1932 | Stuckey | 52/98 X |
| 2,086,989 | 7/1937 | Raad | 52/100 |
| 2,114,244 | 4/1938 | Zoettl | 52/100 |
| 2,313,363 | 3/1943 | Schmitt | 405/286 |
| 2,545,046 | 2/1951 | Rownd | 52/608 |
| 2,956,300 | 10/1960 | Bruno . | |
| 3,231,668 | 1/1966 | Nishiwaki et al. . | |
| 3,375,963 | 4/1968 | Wang et al. . | |
| 3,825,948 | 7/1974 | Hendershot, III et al. . | |
| 4,213,159 | 7/1980 | King . | |
| 4,752,842 | 6/1988 | Odagiri . | |
| 5,017,049 | 5/1991 | Sievert | 405/284 |
| 5,031,376 | 7/1991 | Bender et al. | 405/284 X |
| 5,032,936 | 7/1991 | Fujioka et al. . | |

FOREIGN PATENT DOCUMENTS

| | | |
|---|---|---|
| 0040464 | 3/1981 | European Pat. Off. . |
| 0091210 | 9/1983 | European Pat. Off. . |

OTHER PUBLICATIONS

Ryan, D. M. "Mechanical Design Considerations for Helical–Scan Videotape Recorders", SMPTE Journal, V. 87, N. 11 (1978), pp. 767–771.

Zahn, H. L., "Friction—Its Influence in Rotary Magnetic Tape Recorders" SMPTE Journal, V. 98, N. 7 (1989), pp. 520–524.

Database WPI, Derwent Publications, Feb. 1991 Abstract, "Forming Quality Magnetic Recording Medium . . . ", Yamanaka et al (91/072,882).

Wightman, W. O., "Air Bearing Tape Guide", IBM Technical Disclosure Bulletin, V. 27, N. 6 (Nov. 1984), pp. 3634–3635.

"Tension Arm Device", Patent Abstracts of Japan, V. 9, N. 163 (Jul. 9, 1985), p. 371.

Koloseus, J. C., "pneumatic Tape Lifter", IBM Technical Disclosure Bulletin, V. 27, N. 9 (Feb. 1985), p. 5346.

Ikuo, S. et al, "Production of Magnetic Recording Medium", Patent Abstracts of Japan, V. 10, N. 316, p. 510.

Fujitsu & Okamura, "Tape Tension Control System", Patent Abstracts of Japan, V. 9, N. 299, p. 408.

Yamagishi, I., "Contactless Thin Web Conveyor . . . ", Database WPI Aug. 1979 (Abstract).

"Appts. mfg. multilayer metal thin film . . . ", Database WPI, May 13, 1988 (Abstract).

*Primary Examiner*—Carl D. Friedman
*Assistant Examiner*—W. Glenn Edwards
*Attorney, Agent, or Firm*—Terry M. Crellin

[57] ABSTRACT

A cast concrete block that is cast on its side and can be separated into at least three construction blocks to be used in constructing a retaining wall system. The cast concrete block has a top face and a bottom face. The block is bounded by an elongate base side, two elongate edge sides and an elongate top side. First and second elongate splitting grooves are formed in at least one of the top face and bottom face. The splitting grooves extend between the top side and the base side. The splitting grooves are spaced inwardly from the opposite first and second edge sides. Preferably, each of the splitting grooves are paired with a corresponding secondary groove in an opposite face of the block so that each splitting groove and its corresponding secondary groove are parallel with each other and lie in a common plane that is substantially perpendicular to the broad faces of the block.

13 Claims, 4 Drawing Sheets

CAST CONCRETE BLOCK AND METHOD OF MAKING SAME

BACKGROUND OF THE INVENTION

1. Field of the Invention

The present invention relates to cast concrete blocks that can be split into three or more individual blocks to be used in the construction of retaining walls without using mortar. The invention further relates to a method of casting the concrete blocks on their side.

2. State of the Art

Cast concrete construction blocks for use in constructing retaining walls without the use of mortar are well known in the art. The individual construction blocks are generally of a rectangular shape and have a lip formed along a rear, bottom side of the blocks. The construction blocks are laid on top of each other with succeeding rows being offset by the width of the lip on the blocks. The lip on each construction block interlocks with the top, rear edge of a block in a row immediately below the block being laid.

In U.S. Pat. No. 5,017,049 there is disclosed a method of casting such concrete construction blocks on their side. In a preferred embodiment of the method taught in U.S. Pat. No. 5,017,049, the construction blocks are cast as a dual block so that each cast block can be split into two construction blocks. There is no disclosure or suggestion in U.S. Pat. No. 5,017,049 of being able to cast a concrete block so that the cast block can be split into three or more construction blocks. Being able to cast a parent block that can be split into three or more construction blocks would greatly increase the efficiency of the molding machine used for casting the blocks. Heretofore, however, there has been no suggestion of a cast concrete block that can be split into three or more construction blocks. Nor has there been any suggestion of a method of making a cast concrete block that can be split into three or more construction blocks.

OBJECTIVES AND BRIEF DESCRIPTION OF THE INVENTION

A principal objective of the invention is to provide a concrete block that is cast on its side as an integral unit and can thereafter be split into at least three separate construction blocks.

An additional objective of the present invention is to provide a method of casting a concrete block as an integral unit and then splitting the block into a least three separate construction blocks.

Another objective of the present invention is to provide a novel shaped concrete block that is cast as an integral unit and thereafter split into at least three separate construction blocks, with at least one of the individual blocks having the shape of a quadrilateral having two parallel sides, a third side perpendicular to the parallel sides and a fourth side that is not parallel with the third side.

The above objectives are achieved in accordance with the present invention by providing a novel cast concrete block that can be separated into at least three construction blocks for use in constructing a retaining wall system. The cast concrete block of the present invention comprises a substantially planar top face and a substantially planar bottom face. The bottom face is spaced from the top face and is substantially parallel to the top face.

The cast concrete block has a substantially straight, elongate base side. First and second substantially straight, elongate edge sides extend upwardly, substantially perpendicular from the base side, with first ends of the first and second edge sides being coexistent with the respective ends of the base side. The cast concrete block has an elongate top side that extends between second ends of the first and second edge sides.

A first elongate groove is provided in at least one of the planar top face and the planar bottom face. The first groove extends between the top side and the base side, with the first groove being substantially perpendicular to the base side and the top side. The first groove is spaced inwardly from the first edge side so as to be positioned between the first edge side and a central transverse axis through the cast concrete block.

A second elongate groove is provided in at least one of the planar top face and planar bottom face. The second groove extends between the top side and the base side, with the second groove being substantially perpendicular to the base side and the top side. The second groove is spaced inwardly from the second edge side so as to be positioned between the second edge side and a central transverse axis through the cast concrete block.

In a preferred embodiment of the present invention there is at least one first groove in each of the planar top face and planar bottom face. These first grooves are formed in pairs on opposite planar faces of the block so that each pair of first grooves are parallel with each other and lie in a common plane that is substantially perpendicular to the planar top face and planar bottom face. In like manner, there is at least one second groove in each of the planar top face and planar bottom face. These second grooves are formed in pairs on opposite planar faces of the block so that each pair of second grooves are parallel with each other and lie in a common plane that is substantially perpendicular to the planar top face and planar bottom face.

The cast concrete block can be split into three individual construction blocks by breaking the cast concrete block along the first and second grooves.

Additional objects and features of the invention will become apparent from the following detailed description, taken together with the accompanying drawings.

THE DRAWINGS

Preferred embodiments of the present invention representing the best modes presently contemplated of carrying out the invention are illustrated in the accompanying drawings in which.

Figure 8:
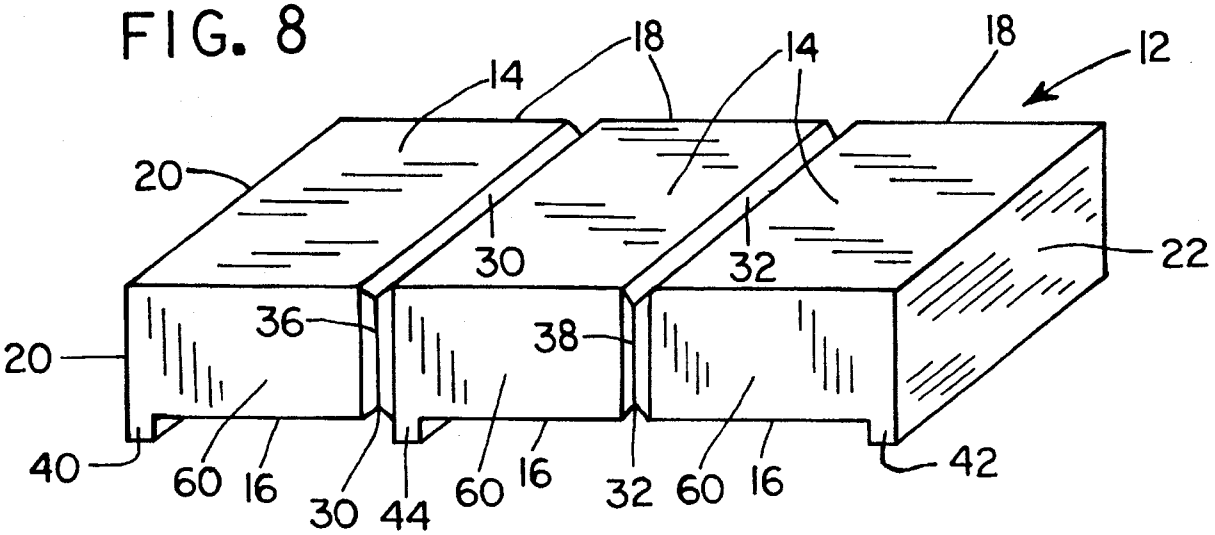
FIG. 8 is a pictorial representation of another preferred embodiment of a cast concrete block in accordance with the present invention.
Figure 9:
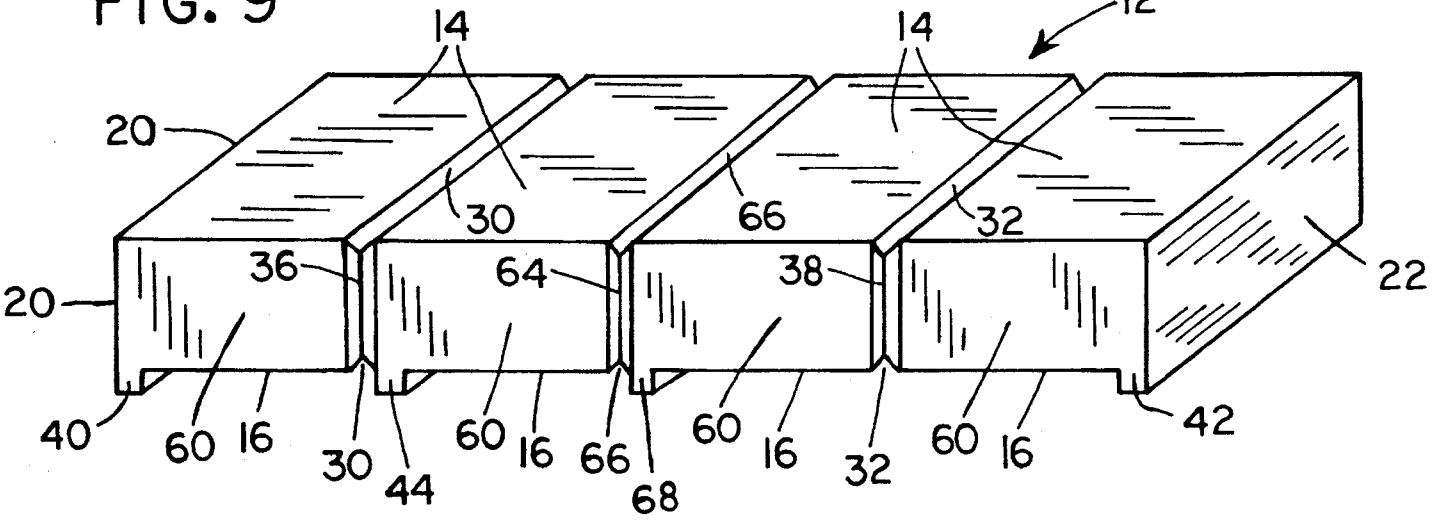
Figure 10:
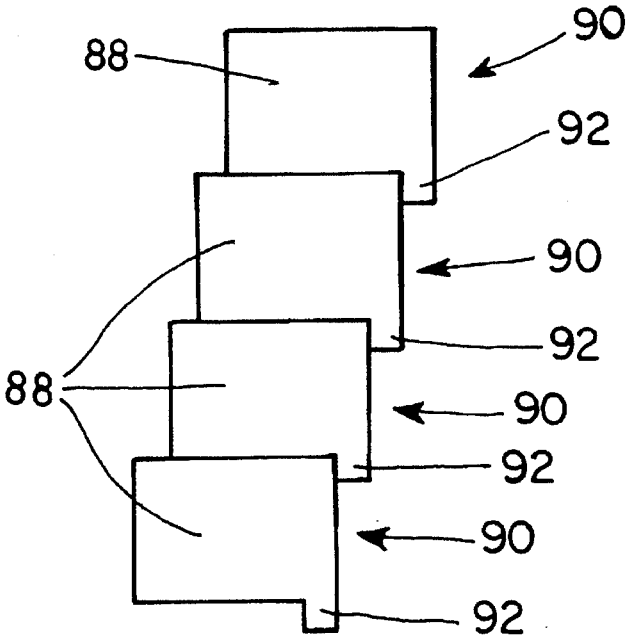
Figure 11:
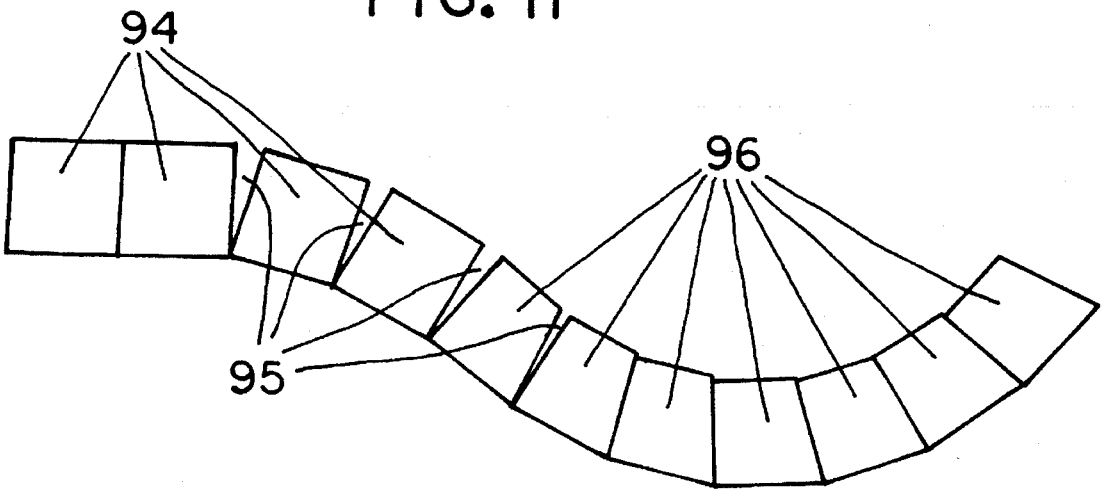

FIG. 9 is a pictorial view of a modified embodiment of a cast concrete block similar to that shown in FIG. 8; and FIG. 10 is a vertical cross section through a wall made of blocks of the present invention, showing each subsequent row of blocks displaced backward from the preceding row, with a lip on each block of the subsequent row engaging the back top side edge of a block in the preceding row; and FIG. 11 is a horizontal cross section through a wall made of blocks of the present invention showing how the blocks that have one end face that slopes slightly toward the other end face can be used to construct a wall having a combination of exposed convex and concave curves.

DETAILED DESCRIPTION OF THE ILLUSTRATED EMBODIMENTS

Referring now to FIGS. 1–4, there is shown one preferred embodiment of a cast concrete block 12 in accordance with the present invention that can be separated into three construction blocks to be used in constructing a retaining wall system. As illustrated, the cast concrete block 12 comprises an elongate, solid block having a substantially planar top face 14 and a substantially planar bottom face 16 that is spaced from the top face 14, with the bottom face 16 and bottom face 14 being substantially parallel to each other.

The perimeter of the block 12 is characterized by a substantially straight, elongate base side 18, first and second, substantially straight, elongate edge sides 20 and 22, and a three part top formed by two slanting top sides 24 and 26 and a flat top side 28. The first edge side 20 has first and second ends, with the first end of the first edge side 20 being coexistent with a first end of the base side 18. The first edge side 20 is oriented so as to extend substantially perpendicular from the base side 18.

The second edge side 22 has first and second ends, with the first end of the second edge side 22 being coexistent with the second end of the base side 18. The second edge side 22 extends substantially perpendicular from the base side 18 so that the second edge side 22 is substantially parallel with the first edge side 20.

The slanting top sides 24 and 26 are formed by substantially straight, elongate top segments, each having first and second ends. The first end of the first top side 24 is coexistent with the second end of the first edge side 20. The first top side 24 extends toward the second edge side 22 while also slanting upwardly in a direction away from the base side 18, so that the first top side 24 forms an obtuse angle of between about 95 degrees and 115 degrees with the first edge side 20. The first end of the second top side 26 is coexistent with the second end of the second edge side 22. The second top side 26 extends toward the first edge side 20 while also slanting upwardly in a direction away from the base side 18, so that the second top side 26 forms an obtuse angle of between 95 degrees and 115 degrees with the second edge side 22.

The flat top side 28 of the top comprises a third substantially straight, elongate segment having first and second ends. The first end of the flat top side 28 is coexistent with the second end of the first top side 24, and the second end of the flat top side 28 is coexistent with the second end of the second top side 26, so that the flat top side 28 is essentially parallel with the base side 18.

A first elongate face groove 30 is provided in at least one of the top face 14 and the bottom face 16 of the block 12. Each first face groove 30 extends between the second end of the first top side 24 and the base side 18. Each first face groove 30 is substantially perpendicular to the base side 18. In the preferred embodiment illustrated in FIGS. 1–4, there is a first face groove 30 in each of the top face 14 and bottom face 16, and these first face grooves 30 form a pair of grooves that are positioned parallel with each other and lie in a common plane that is substantially perpendicular to the broad faces 14 and 16 of the block 12.

A second elongate face groove 32 is provided in at least one of the top face 14 and the bottom face 16 of the block 12. Each second face groove 32 extends between the second end of the second top side 26 and the base side 18. Each, second face groove 32 is substantially perpendicular to the base side 18. In the preferred embodiment illustrated in FIGS. 1–4, there is a second face groove 32 in each of the top face 14 and bottom face 16, and these second face grooves 32 form a pair of grooves that are positioned parallel with each other and lie in a common plane that is substantially perpendicular to the broad faces 14 and 16 of the block 12.

The cast concrete block 12 as illustrated in FIGS. 1–4 can be split into three individual construction blocks by breaking the cast concrete block along the first and second face grooves 30 and 32. The block 12 is preferably split into the separate construction blocks while the block 12 is standing upwardly from its base side. The splitting of the block 12 is done by advancing splitting knives into contact with the top and base side of the block 12. The knives are oriented in a plane through the pairs of first and second face grooves 30 and 32.

Figure 1:
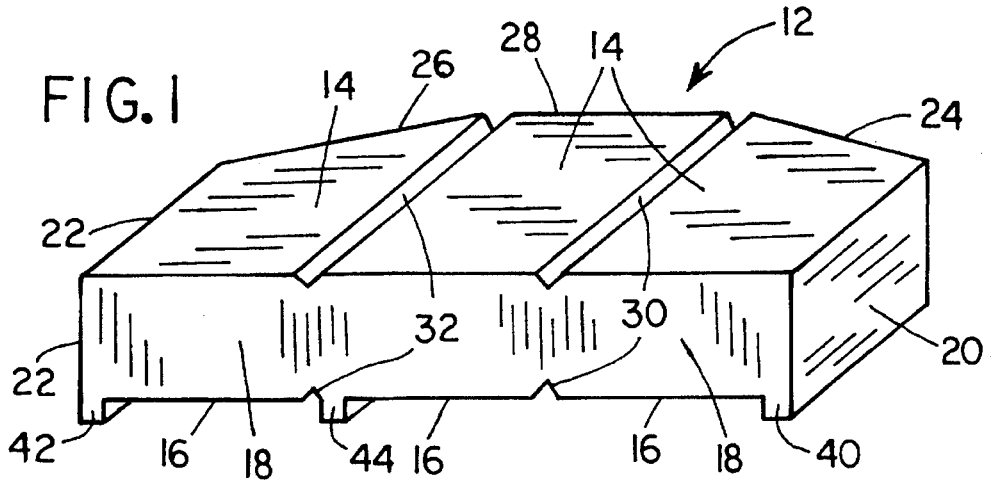
FIG. 1 is a pictorial representation of one preferred embodiment of a cast concrete block in accordance with the present invention that can be split into three distinct construction blocks.
Figure 2:
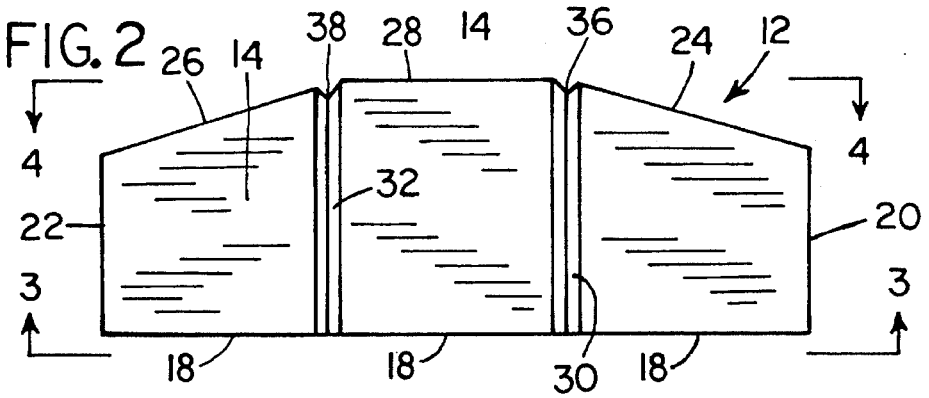
FIG. 2 is a top view of the cast concrete block of FIG. 1.
Figure 3:
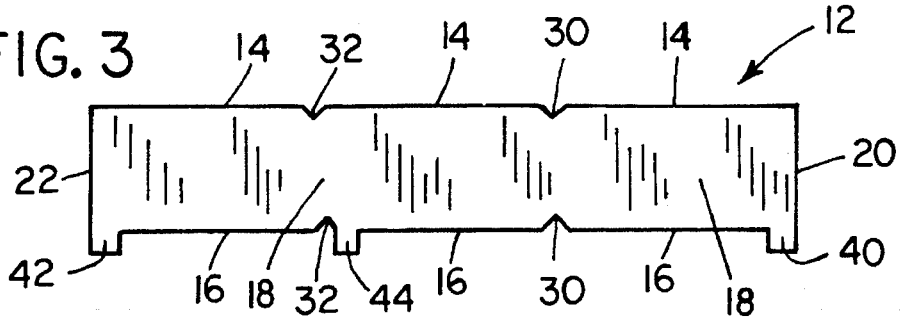
FIG. 3 is a side view of the block of FIGS. 1 and 2 taken along line 3—3 of FIG. 2.
Figure 4:
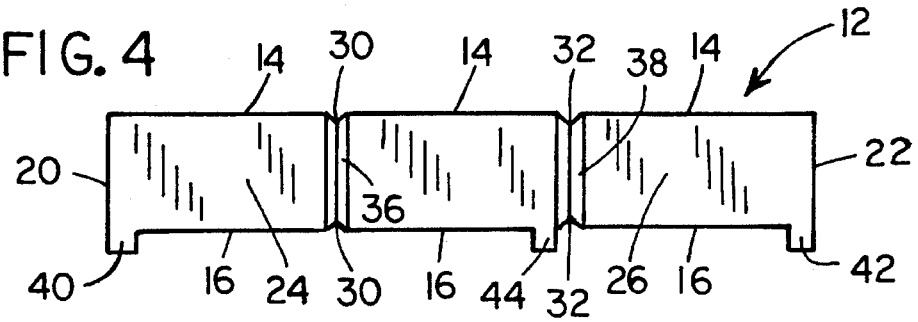
FIG. 4 is another side view of the block of FIGS. 1 and 2 taken along line 4—4 of FIG. 2.

Because the knives that contact the top of the block 12 make contact at the juncture of the flat portion 28 and the slanting portions 24 and 26 of the top, it has been found advantageous to provide guide grooves in the top for the knives. As shown in FIGS. 2 and 4, the guide grooves comprise a first elongate side groove 36 extending along the coexistent first end of the third top side 28 and the second end of the first top side 24. A second elongate side groove 38 extends along the coexistent second end of the third top side 28 and the second end of the second top side 26.

The cast concrete block 12 as illustrated in FIGS. 1–4 further comprises a first lip 40 projecting downwardly from the bottom face 16. The first lip 40 is positioned adjacent to the first edge side 20. A second lip 42 projects downwardly from the bottom face 16, with the second lip 42 being positioned adjacent to the second edge side 22. A third lip 44 projects downwardly from the bottom face 16, and the third lip 44 can be positioned adjacent to either the first face groove 30 or the second face groove 32 in the bottom face 16.

As illustrated in FIGS. 1–4, the third lip 44 is positioned adjacent to the second face groove 32 in the bottom face 16 so that the third lip 44 is positioned alongside the side of the second face groove 32 that faces toward the first edge side 20. However, it is again reiterated that the third lip could just as well project downwardly from the bottom surface 16 so that the third lip would be positioned adjacent to the first face groove 30 to lie alongside the side of the first face groove 30 that faces toward the second edge side 22.

It has been common in the art to provide lips on concrete construction blocks such as the lips 40, 42 and 44 as shown in FIGS. 1–4. These lips are advantageously used to interlock rows of blocks in a wall without the use of mortar. As shown in FIG. 10, each succeeding row 90 of blocks 88 is offset rearwardly so that the lips, shown in FIG. 10 by the reference numeral 92, of the blocks 88 of the succeeding rows engages the back side of the blocks 88 in respective lower rows 90. As earth applied pressure from the back side of the wall, the lips 92 prevent the earth from forcing one row 90 of blocks 88 to slip forward over a lower row 90 of blocks 88.

As mentioned above, the lips 92 are commonly used on blocks. However, there is no teaching in the art of being able to form three and four construction blocks, each having a lip adjacent one side, by splitting a large, cast block into the three or four construction blocks. When one large, cast block is split into three or four separate construction blocks; one must form the lip (if lips are provided on each construction block) along at least one of the break lines of the blocks. There is no suggestion in the prior art that one can form a lip adjacent to and alongside a face groove in the bottom face of a large, cast block so that the block can be split along the face groove without damaging the lip that is formed alongside the face groove.

Figure 5:
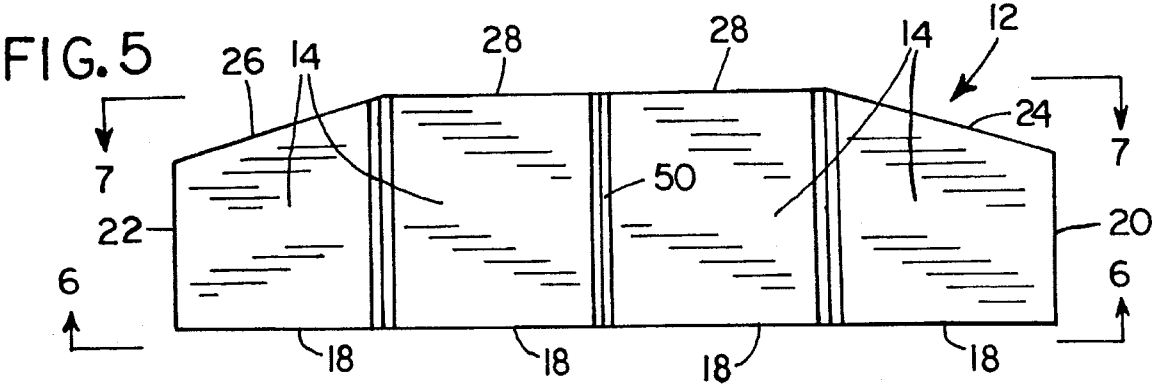
FIG. 5 is a top view of a cast concrete block similar to the block of FIG. 1 but which is elongated so that it can be split into four distinct construction blocks.
Figure 6:
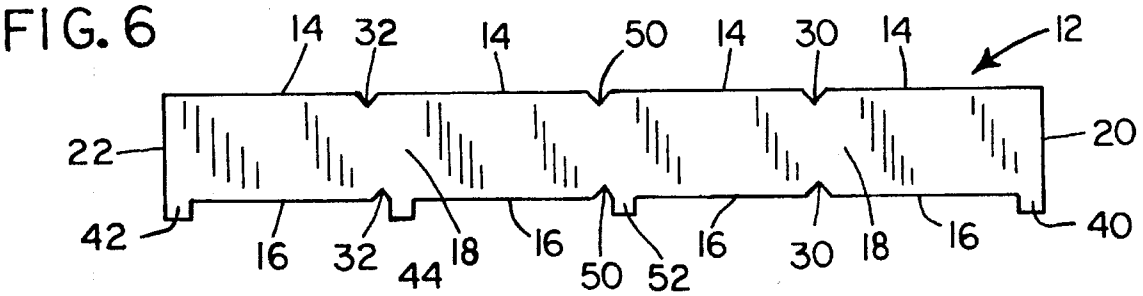
FIG. 6 is a side view of the block of FIG. 5 taken along line 6—6 of FIG. 5.
Figure 7:
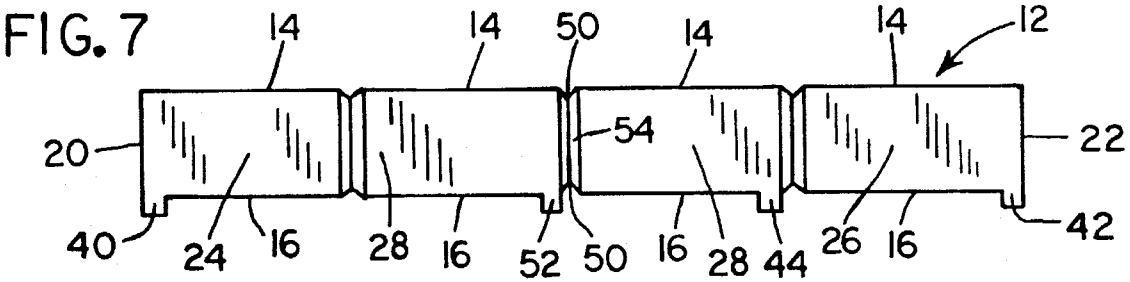
FIG. 7 is another side view of the block of FIG. 5 taken along line 7—7 of FIG. 5.

Referring now to FIGS. 5–7 of the drawings, there is shown a modified embodiment of the cast block 12. The modified embodiment of FIGS. 5–7 is very similar to the embodiment shown in FIGS. 1–4 except that the block 12 of the embodiment shown in FIGS. 5–7 is designed to be broken into four distinct, separate construction blocks instead of three.

The embodiment of FIGS. 5–7 has the same top face, bottom face, first and second edge sides 20 and 22, and a three part top formed by two slanting top sides 24 and 26 and a flat top side 28. The difference between the embodiment of FIGS. 1–4 and the embodiment of FIGS. 5–7 is that the latter embodiment has an elongated portion defined by the flat top side 28 so that that portion can be broken into two similar rectangular construction blocks.

In the embodiment of the cast concrete block 12 illustrated in FIGS. 5–7, a third elongate face groove 50 is provided in at least one of the top face 14 and the bottom face 16. As illustrated in FIGS. 5–7, there is a face groove 50 in both the top face 14 and the bottom face 16. The third face grooves 50 extend between the base side 18 and the third top side 28 so as to be perpendicular to the base side 18 and the third top side 28, with the third face groove 50 being spaced inwardly of the cast concrete block 12 from the first and second face grooves 30 and 32.

In addition to the first, second and third lips 40, 42 and 44 that the block 12 shown in FIGS. 5–7 has in common with the block 12 shown in FIGS. 1–4, a fourth lip 52 projects downwardly from the bottom face 16 for each third face groove 50 in the bottom face 16. Each fourth lip 52 is positioned adjacent to a corresponding third face groove 50 in the bottom face 16. Further, for each third face groove 50, there is advantageously provided third elongate side groove 54 (FIG. 7) in the top side 28 that extends from the third face groove 50 in the top side 28 to a corresponding third face groove 50 in the bottom face 16.

The cast concrete block 12 illustrated in FIGS. 5–7 can be split into four individual construction blocks by breaking the cast concrete block 12 along the first, second and third face grooves 30, 32 and 50. By further elongation of the flat top side 28 and providing additional grooves similar to the third grooves 50, the block 12 could be broken into five or more individual construction blocks.

The unique, irregular shape of the construction blocks obtained from the opposite ends of the cast concrete blocks of FIGS. 1–7, are very advantageous. It should be noted that the top and bottom faces of these irregular shaped blocks are parallel with each other, as are the longitudinal, opposite sides of the blocks. However, the opposite ends of the block are not parallel with each other. The block is not a rectangular block, but instead, one of the ends of the block slants toward the other end.

The irregular shaped blocks, i.e., one end slanted toward the other, are advantageous and highly desirable. When forming a wall that has an S-shaped curve, as shown in FIG. 11, the irregular shaped blocks 96 of the present invention are used so that the spaces between blocks 96 in the S-shaped curve of the wall can be maintained uniform. As shown in the attached FIG. 11, rectangular blocks 94 can be used to form the straight portion and the concave curved portion of a wall. The concave portion will have wide separations 95 facing the back side of the wall, but that is not a detraction inasmuch as that side of the wall is covered with dirt. The exposed side of the wall can be formed with uniform spacing between blocks 95. The irregular shaped blocks 96 of this invention are advantageously used to construct a convex portion of the wall. As shown in FIG. 11, the irregular shaped blocks 96 allow the wall to be formed with no large spaces on the visible side of the wall.

Referring now to FIG. 8, of the drawings, there is shown another modified embodiment of the cast block 12 of the present invention. The modified embodiment of FIG. 8 is very similar to the previous embodiments that have been described, i.e., the embodiments shown in FIGS. 1–4 and in FIGS. 5–7. The block 12 of the embodiment shown in FIG. 8 is designed to be broken into three distinct, separate, substantially identical, rectangular construction blocks.

The embodiment of FIG. 8 has the same top face 14, bottom face 16, base side 18 and first and second edge sides 20 and 22 as the embodiment of FIGS. 1–4. The embodiment of FIG. 8 differs from the embodiment of FIGS. 1–4 in that it has a substantially straight, flat top side 60. The first end of the top side 60 is coexistent with the second end of the first edge side 20, and the second end of the top side 60 is coexistent with the second end of the second edge side 22. The cast block 12 of FIG. 8 is substantially rectangular in shape, with the top side 60 being essentially parallel with the base side 18.

In the embodiment of the cast concrete block 12 illustrated in FIG. 8, first and second elongate face grooves 30 and 32 are provided in the top face 14 and bottom face 16 of the block 12. The grooves 30 and 32 extend between the top side 60 and the base side 18. The grooves 30 and 32 are substantially perpendicular to the top side 60 and the base side 18, and the grooves 30 and 32 are equally spaced from their respective first and second edge sides 20 and 22. The groove 30 is spaced inwardly from the first edge side 20 so as to be positioned between the first edge side 20 and a central transverse axis through the block 12. The groove 32 is spaced inwardly from the second edge side 22 so as to be positioned between the second edge side 22 and the central transverse axis through the block 12. In addition, the grooves 30 and 32 are spaced from each other by the same distance that they are spaced from their respective first and second edge sides 20 and 22.

In common with the embodiment shown in FIGS. 1–4, the cast concrete block 12 shown in FIG. 8 has a first face groove 30 in each of the top face 14 and the bottom face 16, and there is a second face groove 32 in each of the top face 14 and the bottom face 16. The cast concrete block 12 shown in FIG. 8 further comprises a first elongate side groove 36 in the top side 28 that extends from the first face groove 30 in the top face 14 to the first face groove 30 in the bottom face 16. A second elongate side groove 38 is provided in the top side 60 so as to extend from the second face groove 32 in the top face 14 to the second face groove 32 in the bottom face 16.

The cast concrete block 12 as illustrated in FIG. 8 further comprises a first lip 40 projecting downwardly from the bottom face 16. The first lip 40 is positioned adjacent to the first edge side 20. A second lip 42 projects downwardly from the bottom face 16, with the second lip 42 being positioned adjacent to the second edge side 22. A third lip 44 projects downwardly from the bottom face 16, and the third lip 44 can be positioned adjacent to either the first face groove 30 or the second face groove 32 in the bottom face 16.

As illustrated in FIG. 8, the third lip 44 is positioned adjacent to the first face groove 30 in the bottom face 16 so that the third lip 44 is positioned alongside the side of the first face groove 30 that faces toward the second edge side 22. However, it is again reiterated that the third lip could just as well project downwardly from the bottom surface 16 so that the third lip would be positioned adjacent to the second face groove 32 to lie alongside the side of the second face groove 32 that faces toward the first edge side 20.

Referring now to FIG. 9 of the drawings, there is shown a modified embodiment of the cast block 12 that is very similar to the embodiment shown in FIG. 8 except that the block 12 of the embodiment shown in FIG. 9 is designed to be broken into four distinct, separate construction blocks instead of three. The embodiment of FIG. 9 has the same top face 14, bottom face 16, first and second edge sides 20 and 22, and a straight, flat top side 60. The difference between the embodiment of FIG. 8 and the embodiment of FIG. 9 is that the longitudinal length of the block 12 of the latter embodiment is increased and an additional face groove has been provided so that the substantially rectangular shaped block 12 can be broken into four similar sized, rectangular construction blocks.

In the embodiment of the cast concrete block 12 illustrated in FIG. 9, a third elongate face groove 66 is provided in at least one of the top face 14 and the bottom face 16. As illustrated in FIG. 9, there is a face groove 66 in both the top face 14 and the bottom face 16. The third face grooves 66 extend between the base side 18 and the flat top side 60 so as to be perpendicular to the base side 18 and the top side 60, with the third face groove 66 being spaced inwardly of the cast concrete block 12 from the first and second face grooves 30 and 32.

In addition to the first, second and third lips 40, 42 and 44 that the block 12 shown in FIG. 9 has in common with the block 12 shown in FIG. 8, a fourth lip 68 projects downwardly from the bottom face 16 for each third face groove 66 in the bottom face 16. Each fourth lip 68 is positioned adjacent to a corresponding third face groove 66 in the bottom face 16. Further, for each third face groove 66, there is advantageously provided third elongate side groove 64 in the top side 60 that extends from the third face groove 66 in the top side 60 to a corresponding third face groove 66 in the bottom face 16.

The cast concrete block 12 illustrated in FIG. 9 can be split into four individual construction blocks by breaking the cast concrete block 12 along the first, second and third face grooves 30, 32 and 66. By further elongation of the block 12 and by providing additional grooves similar to the third grooves 66, the block 12 could be broken into five or more individual construction blocks.

The cast concrete blocks 12 of the present invention are made by a method comprising the steps of:

(a) filling uncured concrete into an upright mold to cast a green block on its side so that the green block stands vertically upward from its side;

(b) forming at least two elongate, vertically oriented, splitting grooves in one of the upstanding broad faces of the green block as the green block is being cast;

(c) forming an elongate lip alongside all but one of the splitting grooves in the one of the broad faces of the green block;

(d) removing the upright mold from the green block that has been cast; and (e) curing the green block into a solid block while the green block remains standing vertically upward from its side; and The cast concrete block 12 can then be split into at least three individual construction blocks by breaking the solid block 12 along the splitting grooves in the broad faces of the solid block 12.

In practicing the method of the present invention, it is advantageous to include the step of forming at least two secondary grooves in the broad face opposite the one broad face in which the splitting grooves are formed. Each secondary groove corresponds to a respective splitting groove so that each secondary groove and its corresponding splitting groove are parallel with each other and lie in a common plane that is substantially perpendicular to the broad faces of the green block. The method of the present invention can further include the step of forming a side groove in the top side of the green block as it is being cast so that there is a side groove for each splitting groove and each side groove extends between a splitting groove and a corresponding secondary groove.

Although preferred embodiments of the cast concrete block 12 of the present invention have been illustrated and described, it is to be understood that the present disclosure is made by way of example and that various other embodiments are possible without departing from the subject matter coming within the scope of the following claims, which subject matter is regarded as the invention.

We claim:

1. A solid cast concrete block that can be separated into at least three construction blocks to be used in constructing a retaining wall system, said cast concrete block comprising a substantially planar top face;

a substantially planar bottom face that is spaced from said top face and is substantially parallel to said top face;

a substantially straight, elongate base side having a first end and a second end;

a first substantially straight, elongate edge side having first and second ends, with the first end of said first edge side being coexistent with the first end of said base side and with the first edge side extending substantially perpendicular from said base side;

a second substantially straight, elongate edge side having first and second ends, with the first end of said second edge side being coexistent with the second end of said base side and with the second edge side extending substantially perpendicular from said base side so that said second edge side is substantially parallel with said first edge side;

a first substantially straight, elongate top side having first and second ends, with the first end of said first top side being coexistent with the second end of said first edge side and with the first top side extending toward said second edge side, said first top side forming an obtuse angle of between about 95 degrees and 115 degrees with said first edge side;

a second substantially straight, elongate top side having first and second ends, with the first end of said second top side being coexistent with the second end of said second edge side and with the second top side extending toward said first edge side, said second top side forming an obtuse angle of between 95 degrees and 115 degrees with said second edge side;

a third substantially straight, elongate top side having first and second ends, with the first end of said third top side being coexistent with the second end of said first top side, and with the second end of said third top side being coexistent with the second end of said second top side, so that said third top side is essentially parallel with said base side;

a first elongate face groove in at least one of said top face and said bottom face, said first face groove extending between the second end of said first top side and said base side, with said first face groove being substantially perpendicular to said base side; and a second elongate face groove in at least one of said top face and said bottom face, said second face groove extending between the second end of said second top side and said base side, with said second face groove being substantially perpendicular to said base side, whereby said cast concrete block can be split into three individual construction blocks by breaking the cast concrete block along the first and second face grooves.

2. A cast concrete block in accordance with claim 1 wherein there is a first face groove in each of said top face and said bottom face; and there is a second face groove in each of said top face and said bottom face.

3. A cast concrete block in accordance with claim 2 further comprising a first elongate side groove extending along the coexistent first end of said third top side and the second end of said first top side; and a second elongate side groove extending along the coexistent second end of said third top side and the second end of said second top side.

4. A cast concrete block in accordance with claim 2 further comprising a first lip projecting downwardly from said bottom face, with the first lip being positioned adjacent to the first edge side;

a second lip projecting downwardly from said bottom face, with the second lip being positioned adjacent to the second edge side; and a third lip projecting downwardly from said bottom face, with the third lip being positioned adjacent to said second face groove in said bottom face so that said third lip is positioned alongside the side of said second face groove that faces toward said first edge side.

5. A cast concrete block in accordance with claim 2 further comprising a first lip projecting downwardly from said bottom face, with the first lip being positioned adjacent to the first edge side;

a second lip projecting downwardly from said bottom face, with the second lip being positioned adjacent to the second edge side; and a third lip projecting downwardly from said bottom surface, with the third lip being positioned adjacent to said first face groove in said bottom face so that said third lip is positioned alongside the side of said first face groove that faces toward said second edge side.

6. A cast concrete block in accordance with claim 1 further comprising at least one third elongate face groove in at least one of said top face and said bottom face, said third face groove extending between the base side and said third top side so as to be perpendicular to said base side and said third top side, with said third face groove being spaced inwardly of said cast concrete block from said first and second face grooves, whereby said cast concrete block can be split into at least four individual construction blocks by breaking the cast concrete block along the first, second and third face grooves.

7. A cast concrete block in accordance with claim 6 wherein for each third face groove in one of the top face and bottom face, there is a corresponding third face groove in the opposite top face or bottom face.

8. A cast concrete block in accordance with claim 7 further comprising a lip projecting downwardly from said bottom face for each third face groove in said bottom face, said lip being positioned adjacent to a corresponding third face groove in said bottom face.

9. A cast concrete block in accordance with claim 7 wherein for each third face groove in said top face there is a third elongate side groove in said third top side that extends from the third face groove in said top face to a corresponding third face groove in said bottom face.

10. A solid cast concrete block that can be separated into at least three construction blocks to be used in constructing a retaining wall system, said cast concrete block comprising a substantially planar top face;

a substantially planar bottom face that is spaced from said top face and is substantially parallel to said top face;

a substantially straight, elongate base side having a first end and a second end;

a first substantially straight, elongate edge side having first and second ends, with the first end of said first edge side being coexistent with the first end of said base side and with the first edge side extending substantially perpendicular from said base side;

a second substantially straight, elongate edge side having first and second ends, with the first end of said second edge side being coexistent with the second end of said base side and with the second edge side extending substantially perpendicular from said base side so that said second edge side is substantially parallel with said first edge side;

a substantially straight, elongate top side having first and second ends, with the first end of said top side being coexistent with the second end of said first edge side and with the second end of said top side being coexistent with the second end of said second edge side, so that said top side is essentially parallel with said base side;

a first elongate face groove in each of said top face and said bottom face, each of said first face grooves extending between said top side and said base side, with each of said first face grooves being substantially perpendicular to said base side and said top side, and further with each of said first face grooves being spaced inwardly from said first edge side so as to be positioned between said first edge side and a central transverse axis through said cast concrete block;

a second elongate face groove in each of said top face and said bottom face, each of said second face grooves extending between said top side and said base side, with each of said second face grooves being substantially perpendicular to said base side and said top side, and further with each of said second face grooves being spaced inwardly from said second edge side so as to be positioned between said second edge side and a central transverse axis through said block;

a first elongate side groove in said top side that extends from the first face groove in said top face to the first face groove in said bottom face;

a second elongate side groove in said top side that extends from the second face groove in said top face to the second face groove in said bottom face;

a first lip projecting downwardly from said bottom face, with the first lip being positioned adjacent to the first edge side;

a second lip projecting downwardly from said bottom face, with the second lip being positioned adjacent to the second edge side; and a third lip projecting downwardly from said bottom face, with the third lip being positioned adjacent to said second face groove in said bottom face so that said third lip is positioned alongside the side of said second face groove that faces toward said first edge side, whereby said cast concrete block can be split into three individual construction blocks by breaking the cast concrete block along the first and second grooves.

11. A solid cast concrete block that can be separated into at least three construction blocks to be used in constructing a retaining wall system, said cast concrete block comprising a substantially planar top face;

a substantially planar bottom face that is spaced from said top face and is substantially parallel to said top face;

a substantially straight, elongate base side having a first end and a second end;

a first substantially straight, elongate edge side having first and second ends, with the first end of said first edge side being coexistent with the first end of said base side and with the first edge side extending substantially perpendicular from said base side;

a second substantially straight, elongate edge side having first and second ends, with the first end of said second edge side being coexistent with the second end of said base side and with the second edge side extending substantially perpendicular from said base side so that said second edge side is substantially parallel with said first edge side;

a substantially straight, elongate top side having first and second ends, with the first end of said top side being coexistent with the second end of said first edge side and with the second end of said top side being coexistent with the second end of said second edge side, so that said top side is essentially parallel with said base side;

a first elongate face groove in each of said top face and said bottom face, each of said first face grooves extending between said top side and said base side, with each of said first face grooves being substantially perpendicular to said base side and said top side, and further with each of said first face grooves being spaced inwardly from said first edge side so as to be positioned between said first edge side and a central transverse axis through said cast concrete block;

a second elongate face groove in each of said top face and said bottom face, each of said second face grooves extending between said top side and said base side, with each of said second face grooves being substantially perpendicular to said base side and said top side, and further with each of said second face grooves being spaced inwardly from said second edge side so as to be positioned between said second edge side and a central transverse axis through said block;

a first elongate side groove in said top side that extends from the first face groove in said top face to the first face groove in said bottom face;

a second elongate side groove in said top side that extends from the second face groove in said top face to the second face groove in said bottom face;

a first lip projecting downwardly from said bottom face, with the first lip being positioned adjacent to the first edge side;

a second lip projecting downwardly from said bottom face, with the second lip being positioned adjacent to the second edge side; and a third lip projecting downwardly from said bottom face, with the third lip being positioned adjacent to said first face groove in said bottom face so that said third lip is positioned alongside the side of said first face groove that faces toward said second edge side, whereby said cast concrete block can be split into three individual construction blocks by breaking the cast concrete block along the first and second grooves.

12. A cast concrete block in accordance with claim 10 further comprising a third elongate face groove in each of said top face and said bottom face, each of said third face grooves extending between the base side and said top side so as to be perpendicular to said base side and said top side, with each of said third face grooves being spaced inwardly of said cast concrete block from said first and second face grooves;

a third elongate side groove in said top side that extends from the third face groove in said top face to the third face groove in said bottom face;

a fourth lip projecting downwardly from said bottom, said fourth lip being positioned adjacent to said third face groove in said bottom face, whereby said cast concrete block can be split into at least four individual construction blocks by breaking the cast concrete block along the first, second and third face grooves.

13. A cast concrete block in accordance with claim 11 further comprising a third elongate face groove in each of said top face and said bottom face, each of said third face grooves extending between the base side and said top side so as to be perpendicular to said base side and said top side, with each of said third face grooves being spaced inwardly of said cast concrete block from said first and second face grooves;

a third elongate side groove in said top side that extends from the third face groove in said top face to the third face groove in said bottom face;

a fourth lip projecting downwardly from said bottom, said fourth lip being positioned adjacent to said third face groove in said bottom face, whereby said cast concrete block can be split into at least four individual construction blocks by breaking the cast concrete block along the first, second and third face grooves.

* * * * *